US008523346B2

(12) United States Patent
Ito

(10) Patent No.: US 8,523,346 B2
(45) Date of Patent: Sep. 3, 2013

(54) TRANSPORT DEVICE AND RECORDING DEVICE

(75) Inventor: Koji Ito, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 894 days.

(21) Appl. No.: 12/616,061

(22) Filed: Nov. 10, 2009

(65) Prior Publication Data

US 2010/0118099 A1 May 13, 2010

(30) Foreign Application Priority Data

Nov. 11, 2008 (JP) ..... 2008-288930

(51) Int. Cl.
*B41J 2/01* (2006.01)
*B65H 5/00* (2006.01)

(52) U.S. Cl.
USPC ..... 347/104; 271/264

(58) Field of Classification Search
None
See application file for complete search history.

(56) References Cited

U.S. PATENT DOCUMENTS

| | | | | |
|---|---|---|---|---|
| 4,442,439 | A * | 4/1984 | Mizuno | 347/74 |
| 6,158,844 | A * | 12/2000 | Murakami et al. | 347/55 |
| 6,786,590 | B2 * | 9/2004 | Maki et al. | 347/104 |
| 7,334,858 | B2 * | 2/2008 | Kogure et al. | 347/16 |
| 2002/0027588 | A1 | 3/2002 | Kiyama | |
| 2007/0035083 | A1 | 2/2007 | Kawabata | |
| 2007/0103532 | A1 * | 5/2007 | Imoto et al. | 347/104 |
| 2007/0109385 | A1 | 5/2007 | Imoto et al. | |
| 2007/0120936 | A1 | 5/2007 | Kawabata | |
| 2007/0171251 | A1 * | 7/2007 | Sekimoto et al. | 347/22 |
| 2008/0062215 | A1 | 3/2008 | Kawabata | |

FOREIGN PATENT DOCUMENTS

| | | | |
|---|---|---|---|
| JP | 2000-351467 | A | 12/2000 |
| JP | 2002-154711 | A | 5/2002 |
| JP | 2003-103857 | A | 4/2003 |
| JP | 2004-131242 | A | 4/2004 |
| JP | 2004-137016 | A | 5/2004 |
| JP | 2005-324877 | A | 11/2005 |
| JP | 2006-231667 | A | 9/2006 |
| JP | 2007-001138 | A | 1/2007 |
| JP | 2007-045596 | A | 2/2007 |
| JP | 2007-119222 | A | 5/2007 |
| JP | 2007-145523 | A | 6/2007 |
| JP | 2008-068955 | A | 3/2008 |

OTHER PUBLICATIONS

Japan Patent Office, Notice of Reasons for Rejection for Japanese Patent Application No. 2008-288930 (counterpart to above-captioned patent application), mailed Oct. 5, 2010.

* cited by examiner

*Primary Examiner* — Stephen Meier
*Assistant Examiner* — Alexander C Witkowski
(74) *Attorney, Agent, or Firm* — Baker Botts L.L.P.

(57) ABSTRACT

A transport device may include a transport mechanism including a supporting member configured to support a placed medium and transport the medium. The transport device may also include a first charging device configured to alternately charge the supporting member with one polarity and an opposite polarity. The transport device may further include a transfer mechanism configured to transfer the medium to the supporting member. The transport device may yet further include a second charging device configured to alternately charge the medium with one polarity and an opposite polarity for transferring the medium with the transfer mechanism before the transfer mechanism places the medium on the supporting member. The transport device may yet further include a control unit configured to control at least one of the transport mechanism, the transfer mechanism, the first charging device, and the second charging device.

20 Claims, 9 Drawing Sheets

TRANSPORT DEVICE AND RECORDING DEVICE

CROSS REFERENCE TO RELATED APPLICATION

This application claims priority to Japanese Patent Application No. 2008-288930, filed Nov. 11, 2008, the entire subject matter and disclosure of which is incorporated herein by reference.

BACKGROUND OF THE DISCLOSURE

1. Field of the Disclosure

The features herein relate to a transport device and a recording device.

2. Description of the Related Art

A known inkjet recording device applies an AC bias voltage to a conveyor belt for conveying a recording sheet as a recording medium to alternately apply positive charges and negative charges to an insulating layer of the conveyor belt along the moving direction of the conveyor belt. By alternately applying positive charges and negative charges to the conveyor belt in this way, a small AC field is generated near the surface of the conveyor belt. Thus, the recording sheet is attracted to the conveyor belt as a supporting member due to an electrostatic force thereof (Coulomb force), making it possible to prevent the recording sheet from separating from the conveyor belt.

SUMMARY OF THE INVENTION

In the cases of charging only a conveyor belt, however, the following problems occur. Firstly, charges in the conveyor belt cause dielectric polarization in the recording sheet. In addition, charges having an opposite polarity to the charges in the conveyor belt are induced on the surface of the recording sheet while neutralizing the field generated at the conveyor belt. It takes a certain amount of time to attract a recording sheet with a large attraction force by means of the induced charges. Thus, a force of attraction between the recording sheet and the conveyor belt is insufficient during this time. In addition, ink might adhere to the outer side of the conveyor belt in the long-term use of an inkjet recording device in some cases. Since the ink contains carbon black, an organic pigment, and other such conductive materials, the adhered ink makes the outer side conductive more and more. As described above, if a conductive member (an ink layer adhering to the outer side of the conveyor belt, for example) is positioned between the outer peripheral surface of the conveyor belt and the recording sheet, a field applied by the conveyor belt to cause dielectric polarization on a recording sheet is shielded, leading to an insufficient attraction force.

It may be an object of the present invention to provide a transport device and a recording device, which quickly attract a medium to a supporting member for supporting the medium and prevent reduction in attraction force even if a conductive member is positioned between the medium and the supporting member.

According to one embodiment herein, a transport device may comprise a transport mechanism comprising a supporting member configured to support a placed medium and transport the medium along a transport path along with movement of the supporting member. The transport device may also comprise a first charging device configured to alternately charge the supporting member with one polarity and an opposite polarity along the transport path to form a plurality of charged segments in the supporting member. The transport device may further comprise a transfer mechanism configured to transfer the medium to the supporting member to place the medium on the supporting member. The transport device may yet further comprise a second charging device configured to alternately charge the medium with one polarity and an opposite polarity along the transfer path for transferring the medium with the transfer mechanism before the transfer mechanism places the medium on the supporting member to form a plurality of charged segments in the medium. The transport device may yet further comprise a control unit configured to control at least one of the transport mechanism, the transfer mechanism, the first charging device, and the second charging device such that a charging pattern of the placed medium and a charging pattern of the supporting member have a predetermined relationship on the supporting member.

DETAILED DESCRIPTION OF EMBODIMENTS

Various embodiments, and their features and advantages, may be understood by referring to FIGS. 1-8, like numerals being used for corresponding parts in the various drawings.

Figure 1:
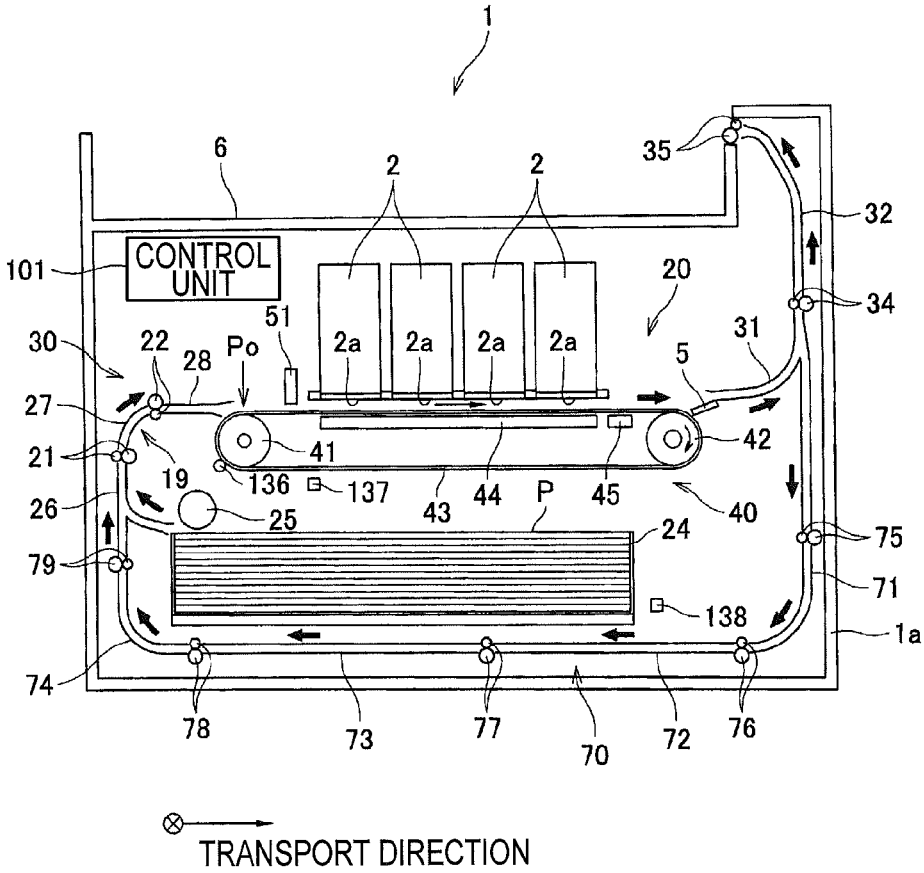
FIG. 1 is a side view of an inner portion of an inkjet printer including a transport device according to an embodiment.

Referring to FIG. 1, an inkjet printer 1 as a printing apparatus includes a rectangular solid casing 1*a*. A discharge recess 6 is formed on the upper side of the casing 1*a*. The casing 1*a* includes a control unit 101 for controlling an operation of the printer 1 and a plurality of, e.g., four, inkjet heads 2 for ejecting magenta ink, cyan ink, yellow ink, and black ink.

Figure 2:
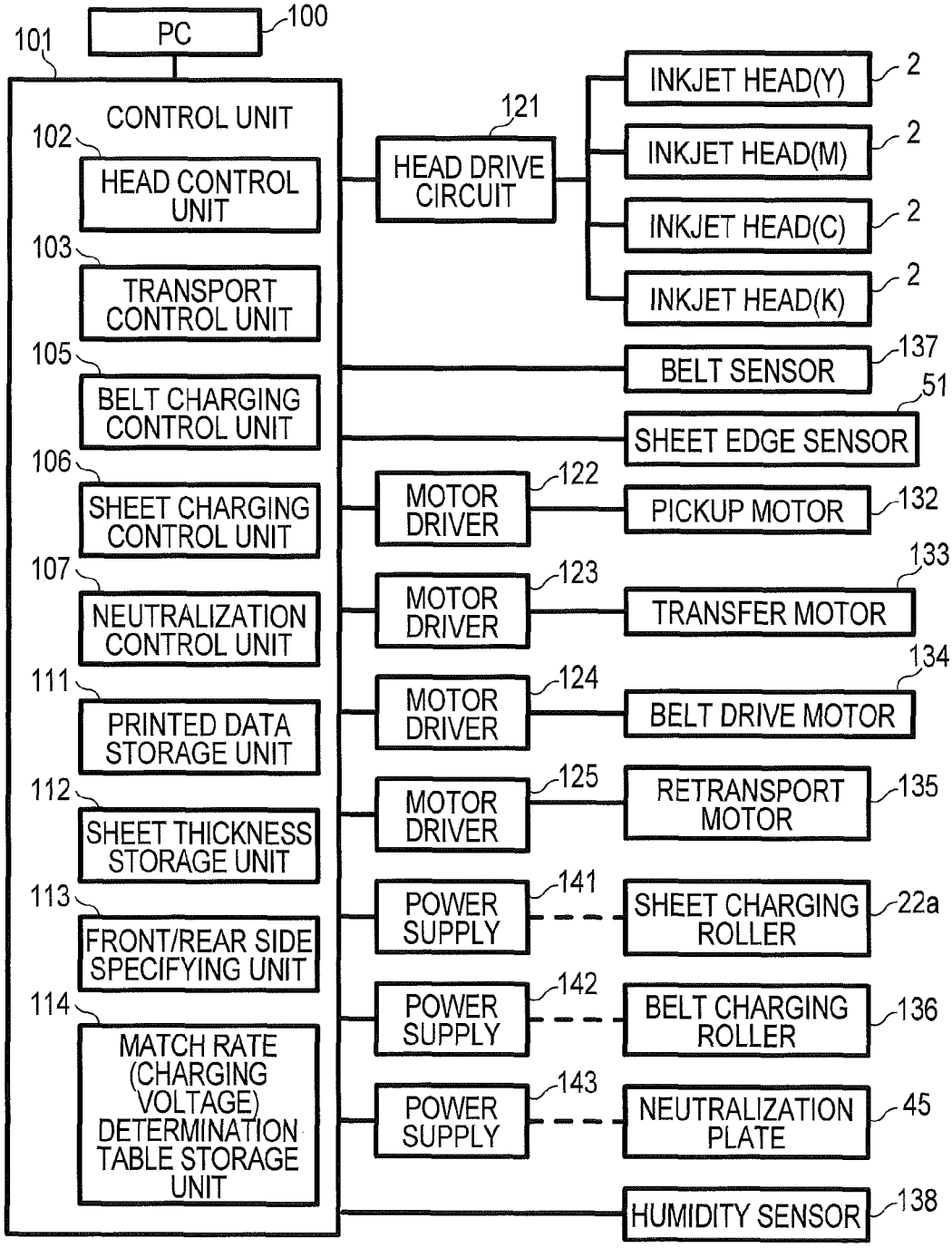
FIG. 2 is a block diagram of the inkjet printer shown in FIG. 1.

Referring to FIG. 2, the control unit 101 is connected to a personal computer (PC) 100. Each head 2 is driven by a head drive circuit 121. The head 2 is grounded through the casing 1*a*. The lower surface of each head 2 is configured as an ejection surface 2*a* where a plurality of ejection ports for ejecting ink are formed. A transport unit 40 for transporting a sheet P as a printing medium in a transport direction extending from the left to the right in FIG. 1 is positioned below the plurality of heads 2. In addition, a feeding cassette 24 capable of storing a plurality of stacked sheets P is positioned below the transport unit 40.

The casing 1*a* includes members such as a pickup roller 25, the transport unit 40, transport guides 26 to 28, 31, 32, and 71 to 74, and transport roller pairs 21, 22, 34, 35, and 75 to 79 to thereby form a transfer path 19, a transport path 20, and a retransport path 70. The sheet P passes through the feeding cassette 24, the transfer path 19, and the transport path 20 in this order and reaches the discharge recess 6. The retransport path 70 retransports the sheet P conveyed with the transport unit 40 such that an opposite surface to the surface that came into contact with ejection surfaces 2*a* of the plurality of heads 2 upon previous transport comes into contact therewith. The retransport path 70 branches off from the transport path 20 on the downstream side of the plurality of heads 2 (more specifically, the transport guide 31), and merges into the transfer path 19 in a position between the outlet of the feeding cassette 24 and the plurality of heads 2 (more specifically, the transport guide 26).

The sheet P in the feeding cassette 24 is transferred with a transfer unit 30 to the transport unit 40. The transfer unit 30 includes the pickup roller 25, the plurality of, e.g., three, transport guides 26, 27, and 28, and the plurality of, e.g., two, transport pairs 21 and 22. The pickup roller 25 successively picks up and feeds the uppermost one of the plurality of sheets P stacked in the feeding cassette 24. The pickup roller 25 is rotated by a pickup motor 132. The pickup motor 132 is driven by a motor driver 122. Along with the rotation of the pickup roller 25, the sheet P fed from the feeding cassette 24 is guided by the plurality of transport guides 26, 27, and 28 that define the transfer path 19 while being transported to the transport unit 40 by the plurality of transport roller pairs 21 and 22. One roller of the transport roller pair 21 and one roller of the transport roller pair 22 are drive rollers rotating by a driving force of a transfer motor 133 controlled by the control unit 101. The other roller of the transport roller pair 21 and the other roller of the transport roller pair 22 are driven rollers rotated along with rotation of the one roller of the transport roller pair 21 and one roller of the transport roller pair 22. The transfer motor 133 is driven by a motor driver 123. In this embodiment, the transfer unit 30, the pickup motor 132, the transfer motor 133, and the motor drivers 122 and 123 may configure the transfer mechanism.

Figure 3A:
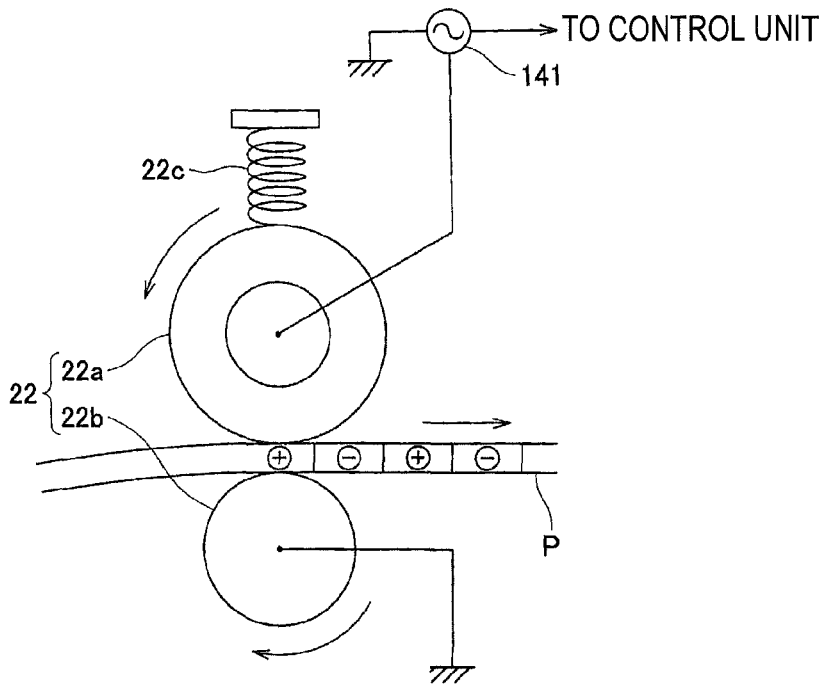
FIG. 3A is an enlarged view of a transport roller pair and a sheet.

Referring to FIG. 3A, the transport roller pair 22 includes a plurality of, e.g., two, sheet charging rollers 22*a* and 22*b*. The surface of at least one of the plurality of sheet charging rollers 22*a* and 22*b* has an insulating property, and the sheet charting roller is connected to the control unit 101 for determining a charging voltage through a power supply 141. The sheet charging roller 22*a* includes a metal rotational shaft and a surface layer made of a resin elastic member. The rotational shaft is connected to the power supply 141. The surface layer is a high-resistance member having substantially the same volume resistivity as the conveyor belt 43. The rotational shaft is biased to one charging roller, the sheet charging roller 22*b* by a spring 22*c* as a biasing member. The sheet charging roller 22*b* functions as an opposing electrode for the sheet charging roller 22*a* and is grounded. The biasing member including the spring 22*c*, the plurality of sheet charging rollers 22*a* and 22*b*, and the power supply 141 may function as a sheet charging device. The power supply 141 generates AC potential having a waveform in which +500 V and −500 V repeatedly appear at short intervals ($8\times10^{-3}$ seconds). The sheet charging roller 22*a* alternately charge the sheet P with a positive polarity and a negative polarity along the transfer path 19 while in come into one surface of the sheet P (opposite surface of the surface in contact with the conveyor belt 43 as described below). The sheet charging roller 22*a* forms a plurality of belt-like charged segments on the sheet P. The segments extend in a direction orthogonal to the transfer direction of the sheet P. A charging potential on the surface of the sheet P is ±400 V. The length of one charged segment in the transfer direction is about 5 mm to 30 mm. This length is much shorter than the length of the sheet P along the transfer path.

The transport unit 40 includes a plurality of, e.g., two, parallel belt rollers 41 and 42, and the endless conveyor belt 43 as a supporting member stretched over the plurality of rollers 41 and 42. The belt roller 42 is rotated by a belt drive motor 134. The outer surface of the conveyor belt 43 is made of a polyvinylidene difluoride (PVDF) layer having the thickness of 150 μm, and the volume resistivity of about $10^{13}$ Ω·cm to $10^{15}$ Ω·cm. The transport unit 40 may be configured simply using the plurality of belt rollers 41 and 42 and the conveyor belt 43 as above. The outer surface of the conveyor belt 43 may be made of a high-resistance material such as PET, ETFE, PTFE, or polyimide in addition to PVDF. Further, the conveyor belt 43 may have a two-layer structure. In this case, the outer surface (outer layer) of the belt is preferably given higher resistance than the inner surface (inner layer) to reduce a speed of neutralization of charges between the sheet P and the conveyor belt 43. For example, a base material, PVDF is used for the outer layer, and carbon-contained PVDF is used for the inner layer to adjust a resistance value. Thus, the resistance of the inner layer is set lower than the outer layer. PET, ETFE, PTFE, and polyimide are preferred as the base material in addition to PVDF. The conveyor belt 43 is a belt made of PVDF as a base material and has one-layer structure. The belt drive motor 134 is driven by the motor driver 124. The transport unit 40, the belt drive motor 134, and the motor driver 124 may configure the transport mechanism.

The sheet P transferred with the transfer unit 30 is positioned on the conveyor belt 43 as the supporting member. The transport unit 40 conveys the sheet P in the transport direction such that one surface of the sheet P comes into contact with the plurality of, e.g., four, heads 2 at a predetermined timing along with the driving operation of the belt drive motor 134. When the sheet P passes below each head 2, the heads successively eject ink of corresponding color to the sheet P to thereby form a desired color image on the sheet P.

Figure 3B:
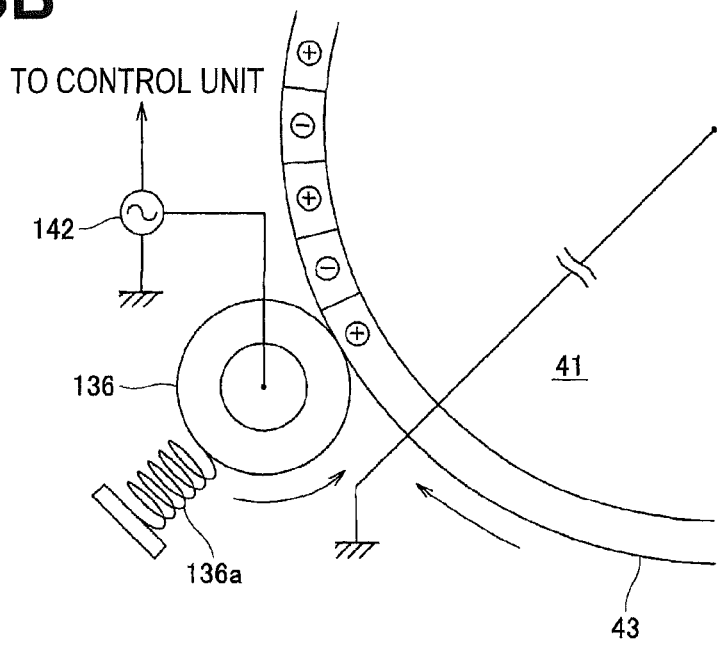
FIG. 3B is an enlarged view of a belt charging roller and a conveyor belt.

A given portion of the conveyor belt 43 on the outer peripheral surface of the belt roller 41 is held between the belt roller 41 and the belt charging roller 136. The belt charging roller 136 includes a metal-made shaft center, and an elastic layer made of urethane rubber or the like and surrounding the shaft center. On the surface thereof, a protective layer made of nylon or resin fluoride having a high mechanical strength is formed. The protective layer formed on the surface of the elastic layer is an intermediate-resistance ($10^6$ to $10^{10}$ Ωcm) layer. Further, the shaft center is connected to the control unit 101 through the power supply 142 for determining a charging voltage. The configuration of the belt charging roller 136 is similar to that of the sheet charging roller 22*a*. The belt charging roller 136 includes a metal rotational shaft and a resin elastic surface layer. The rotational shaft is connected to the power supply 142. The belt charging roller 136 is biased to the opposing belt roller 41 by a spring 136*a* as a biasing member. The belt roller 41 functions as a conductive opposing electrode for the belt charging roller 136, and is grounded through the casing 1*a*. The biasing member including the spring 136*a*, the belt charging roller 136, and the power supply 142 inclusive of the belt roller 41 of the transport mechanism function as a belt charging device. The power supply 142 generates AC potential having a waveform in which +1000 V and −1000 V repeatedly appear at short intervals (8×10−3 seconds). Thus, the belt charging roller 136 can alternately charge the conveyor belt 43 with positive and negative polarities along the transport path 20 while in contact with the outer surface of the conveyor belt 43 as shown in FIG. 3B. The belt charging roller 136 forms a plurality of belt-like charged segments in the conveyor belt 43. The segments extend in a direction orthogonal to the transport direction of the sheet P. The charging potential at the outer surface of the conveyor belt 43 is ±500 V. In other words, a charging amount of one charged segment of the sheet P is smaller than that of one charged segment of the conveyor belt 43. The length of one charged segment in the transport direction is about 5 mm to 30 mm like the charged segment formed in the sheet P. This length is much shorter than the length of the sheet P along the transport path. To given an example thereof, if the length of one charged segment is 20 mm in the printer 1 that ejects ink droplets at 20 kHz to realize a dot density of 600 dpi on the sheet P, the ½ period (on time) of the power supply 142 is about 23 ms.

Figure 4A:
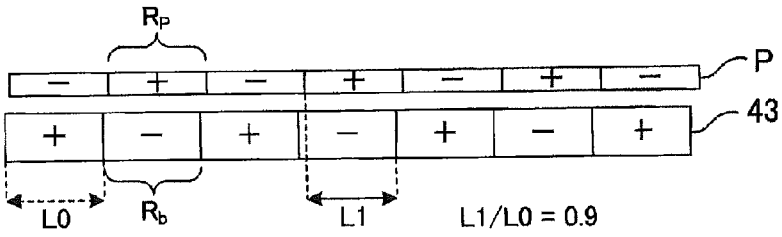
FIGS. 4A to 4C are schematic diagrams of a relationship between a charged segment formed in a sheet and a charged segment formed in a conveyor belt.
Figure 4B:
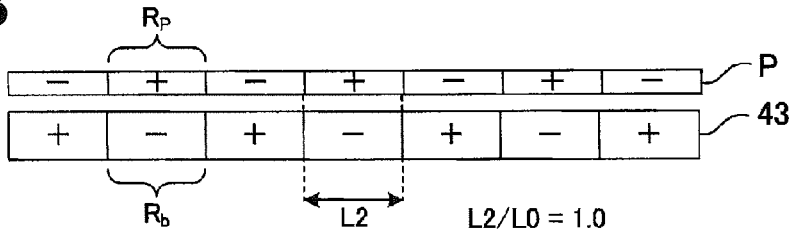
Figure 4C:
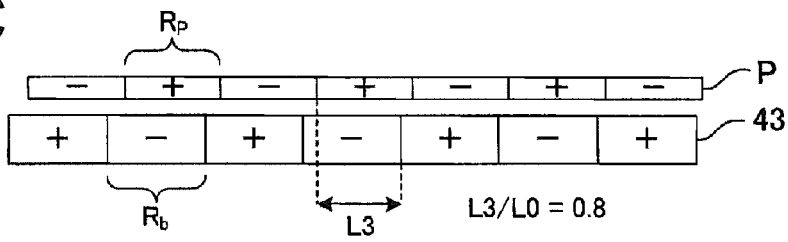

Referring to FIGS. 4A to 4C, a relationship between the charged segment formed in the sheet P and the charged segment formed in the conveyor belt 43 is described. The length of the charged segment along the transport path is L0 in both of the sheet P and the conveyor belt 43. The control unit 101 controls the motor driver 122 for the pickup motor 132 and the motor driver 123 for the transfer motor 133 such that a charging pattern of the sheet P and a charging pattern of the conveyor belt 43 have a predetermined relationship (positional relationship) on the conveyor belt 43. To elaborate, the control unit 101 controls the motor driver 122 for the pickup motor 132 and the motor driver 123 for the transfer motor 133 such that a match rate indicating a rate of a charged segment Rp of an opposite polarity formed in the sheet P and overlapped with the conveyor belt 43 to a charged segment Rb formed in the conveyor belt 43 is set to a predetermined value as well as the same applies to every charged segment Rb formed in the conveyor belt 43. This control is made based on a belt detection signal output from a belt sensor 137 as described below.

The control unit 101 controls the motor driver 122 for the pickup motor 132 and the motor driver 123 for the transfer motor 133 such that the match rate is variable. The match rate takes a plurality of, e.g., three, values as described above, i.e., 0.9 (L1 shown in FIG. 4A), 1.0 (L2 shown in FIG. 4B), and 0.8 (L3 shown in FIG. 4C). The control unit 101 determines the match rate based on the internal humidity of the casing 1*a*, the thickness of the sheet P, and whether to form an image on the front side or back side upon two-sided printing. If the match rate is 1.0, the charged segment Rp of an opposite polarity formed in the sheet P opposes the charged segment Rb formed in the conveyor belt 43, on the conveyor belt 43 with no displacement.

A flat platen 44 made of an insulating resin is disposed in a region surrounded by the conveyor belt 43 and opposing the plurality of, e.g., four, heads 2. The flat platen 44 secures flatness of the sheet P and a predetermined distance between the ejection surface 2*a* and the conveyor belt 43 upon printing. Since the flat platen 44 has an insulating property, the charged conveyor belt 43 is prevented from being neutralized by brining into contact with the flat platen 44. Here, it is preferred to reduce friction force between the flat platen 44 and the inner side of the conveyor belt 43. Owing to the friction force between the flat platen and the inner side and the charged conveyor belt 43, the conveyor belt 43 is attracted to the flat platen 44 with small attraction force. Thus, the conveyor belt 43 is prevented from floating from the flat platen 44.

In an inner space of the conveyor belt 43, a neutralization plate 45 having an insulating surface is disposed between the flat platen 44 and the belt roller 42. An upper surface of the neutralization plate 45 is at the same height as the upper surface of the flat platen 44. The neutralization plate 45 is connected to the control unit 101 through the power supply 143. The neutralization plate 45 and the power supply 143 function as the neutralization device for the conveyor belt 43. The power supply 143 for determining a neutralization voltage generates AC potential having a waveform in which +500 V and −500 V appear at short intervals ($8\times10^{-3}$ seconds). A phase of the AC potential generated with the power supply 143 is opposite to a phase of the charged segment in the conveyor belt 43 on the neutralization plate 45. Hence, the neutralization plate 45 comes into contact with the inner side of the conveyor belt 43 (an opposite surface to the supported surface of the sheet P on the conveyor belt 43) to neutralize the conveyor belt 43. Thus, the neutralization plate 45 does not hinder the transfer of the sheet P. Here, the length of the neutralization plate 45 in the transfer direction is set not longer than the length of one charged segment in the conveyor belt 43. In this example, the length is about ¼ of the length of one charged segment.

A sheet edge sensor 51 is disposed between the transport roller pair 22 and the inkjet head 2 at the most upstream position. The sheet edge sensor 51 is, for example, an optical reflective or transmission sensor. The sheet edge sensor 51 outputs a sheet edge detection signal indicating that the front edge of the sheet P placed on the conveyor belt 43 reaches a position below the sheet edge sensor 51. The sheet edge detection signal is supplied to the control unit 101.

The belt sensor 137 as an operation sensor for the conveyor belt 43 is positioned below the conveyor belt 43. The belt sensor 137 is, for example, an optical reflective or transmission sensor. The belt sensor 137 outputs a belt detection signal indicating that a mark (not shown) formed on the outer peripheral surface of the conveyor belt 43 reaches a position opposite to the belt sensor 137. The belt detection signal is supplied to the control unit 101. The mark formed on the conveyor belt 43 is away from a region in which the sheet is placed on the outer surface of the conveyor belt 43, by a predetermined distance. A plurality of sheet placement regions are formed on the conveyor belt 43 with reference to the mark position. The sheet placement region has the same length as the sheet P along the transport path.

The belt detection signal output from the belt sensor 137 is used to control the motor driver 122 for the pickup motor 132 and the motor driver 123 for the transfer motor 133 such that the sheet P conveyed with the transfer unit 30 is placed in the sheet placement region of the conveyor belt 43. Moreover, the belt detection signal is used to control the power supplies 141 and 142 such that the power supply 142 for the belt charging roller 136 operates only in a period for charging the sheet placement region, and the power supply 141 for the plurality of, e.g., two, sheet charging rollers 22*a* and 22*b* operates only in a period for charging the sheet P. Here, instead of disposing the belt sensor 137, an encoder as the operation sensor may be connected to the belt roller 41 or 42 to detect an operation of the conveyor belt 43.

A separation plate 5 is positioned on the downstream side of the transport direction of the transport unit 40. The separation plate 5 separates the sheet P from the conveyor belt 43 by inserting its front edge in between the sheet P and the conveyor belt 43.

The sheet P separated from the conveyor belt 43 by the separation plate 5 is guided by the transport guides 31 and 32 while being transferred to the upstream side by the transport roller pairs 34 and 35, and then discharged to the discharge recess 6. One roller of the transport roller pair 34 and one roller of the transport roller pair 35 are drive rollers rotating by a driving force of the transfer motor 133. The other roller of the transport roller pair 34 and the other roller of the transport roller pair 35 are driven rollers rotated along with the rotation of the one roller of the transport roller pair 34 and the one roller of the transport roller pair 35.

The drive rollers of the transport roller pairs 34 and 35 can rotate in forward and reverse directions. Accordingly, after the rear end of the sheet P conveyed by the transport unit 40 passed a position where the path branches to the retransport path 70, the transport roller pairs 34 and 35 are rotated in the reverse direction, making it possible to switch back the sheet P. The switched-back sheet P is conveyed to the retransport path 70.

The retransport path 70 includes a plurality of, e.g., four, transport guides 71, 72, 73, and 74 and a plurality of, e.g., five, transport roller pairs 75, 76, 77, 78, and 79. In the retransport path 70, the sheet P is guided by the transport guides 71, 72, 73, and 74 while being transferred by the transport roller pairs 75, 76, 77, 78, and 79. Rollers on one side of the transport roller pairs 75, 76, 77, 78, and 79 are drive rollers rotating by a driving force of a retransport motor 135. Rollers on the other side of the transport roller pairs 75, 76, 77, 78, and 79 are driven rollers rotated along with the rotation of the one rollers. The retransport motor 135 is driven by a motor driver 125.

The sheet P passed through the retransport path 70 and merged into the transfer path 19 at the transport guide 26 is conveyed to the transport unit 40 while a surface opposite to the surface that came into contact with the ejection surfaces 2*a* of the plurality of heads 2 upon previous transport comes into contact therewith. Then, the sheet P passes a portion below the plurality of heads 2. At this time, the plurality of heads 2 successively eject ink to thereby form a color image on the rear side of the sheet P as well.

The humidity sensor 138 is positioned inside the casing 1*a*. A humidity signal output from the humidity sensor 138 is supplied to the control unit 101, and used to adjust the match rate in accordance with the humidity to control a timing for generating AC potential with the power supply 141.

The control unit 101 includes a CPU, an EEPROM for storing programs to be executed by the CPU and data used for the programs in a data rewritable manner, and a RAM for temporarily storing data upon execution of a program. The control unit 101 functions as a head control unit 102, a transport control unit 103, a belt charging control unit 105, a sheet charging control unit 106, a neutralization control unit 107, a printed data storage unit 111, a sheet thickness storage unit 112, a front/rear side specifying unit 113, and a match rate determination table storage unit 114 by executing these hardware components and software components in the EEPROM in cooperation with each other.

The printed data storage unit 111 stores printed data regarding an image to be formed on the sheet P, which is transmitted from the PC 100. The head control unit 102 controls the head drive circuit 121 to eject ink from each inkjet head 2 at a desired timing based on the printed data stored in the printed data storage unit 111.

The transport control unit 103 controls the motor drivers 122 to 125 to transport the sheet P along the transfer path 19, the transport path 20, and the retransport path 70 at a desired timing. The transport control unit 103 controls the motor driver 122 for the pickup motor 132 and the motor driver 123 for the transfer motor 133 so as to set the match rate to one of 0.8, 0.9, and 1.0 based on the internal humidity of the casing 1*a*, the thickness of the sheet P, and whether to print an image on the front side or the back side, and so as to place the sheet P on the conveyor belt 43 based on the determined match rate.

The belt charging control unit 105 controls an operation timing of the power supply 142 connected to the belt charging roller 136 based on a belt detection signal output from the belt sensor 137. The sheet charging control unit 106 controls an operation timing of the power supply 141 connected to the sheet charging roller 22*a*(22*b*) based on a belt detection signal output from the belt sensor 137.

The neutralization control unit 107 controls an operation timing of the power supply 143 for the neutralization plate 45 based on a sheet edge detection signal output from the sheet edge sensor 51. To elaborate, the power supply 143 is operated only for a predetermined period from the time when the sheet edge detection signal was output. In this predetermined period, the neutralization plate 45 opposes the plurality of charged segments formed in the conveyor belt 43.

The sheet thickness storage unit 112 stores one or more identification numbers for identifying the sheet P in association with the thickness of each sheet. The data stored in the sheet thickness storage unit 112 can be rewritten based on data input by a user. Moreover, the sheet thickness storage unit 112 specifies a so-called active identification number (sheet type of the sheet P stored in the feeding cassette 24) indicating which of one or more identification numbers correspond to the target sheet P together with the thickness thereof. The specified information can be changed by user operation on buttons.

The front/rear side specifying unit 113 stores a front/rear side specifying flag indicating whether to print an image on a surface of the sheet P upon the single-sided printing, a first surface (front surface) upon the two-sided printing, or a second surface (rear surface) upon the two-sided printing in the next operation. The front/rear side specifying flag stored in the front/rear side specifying unit 113 is rewritten each time an operation of printing an image on one side of the sheet P is completed.

The match rate determination table storage unit 114 stores a match rate determination table storing a combination of a plurality of consecutive humidity ranges that do not overlap each other, a plurality of consecutive thickness ranges of the sheet P that do not overlap each other, and whether to print an image on the front/rear side upon single-sided printing and two-sided printing in association with three match rates (0.8, 0.9, and 1.0). In other words, a match rate can be uniquely determined in accordance with the internal humidity of the casing 1*a*, and whether to print an image on the front/rear side of the sheet P upon single-sided printing and two-sided printing. The higher the match rate, the thicker the sheet P. Further, the higher the internal humidity of the casing 1*a*, the higher the match rate. Then, the match rate is higher upon single-sided printing and printing on the first surface than upon printing on the second surface.

Here, in the following modified example, in place of the match rate determination table storage unit 114, a charging voltage determination table storage unit is disposed. The charging voltage determination table storage unit stores a combination of a plurality of consecutive humidity ranges that do not overlap each other, a plurality of consecutive thickness ranges of the sheet P that do not overlap each other, and whether to print an image on the front/rear side upon single-sided printing and two-sided printing in association with a plurality of, e.g., three, levels of charging voltage for each of the power supplies 141 and 142. In the charging amount determination table, the thicker the sheet P, the higher the charging voltage for each of the power supplies 141 and 142. In addition, the higher the internal humidity of the casing 1*a* is, the higher the charging voltage is. Further, the charging voltage is lower upon the signal-sided printing and printing on the first surface than upon printing on the second surface.

Figure 5A:
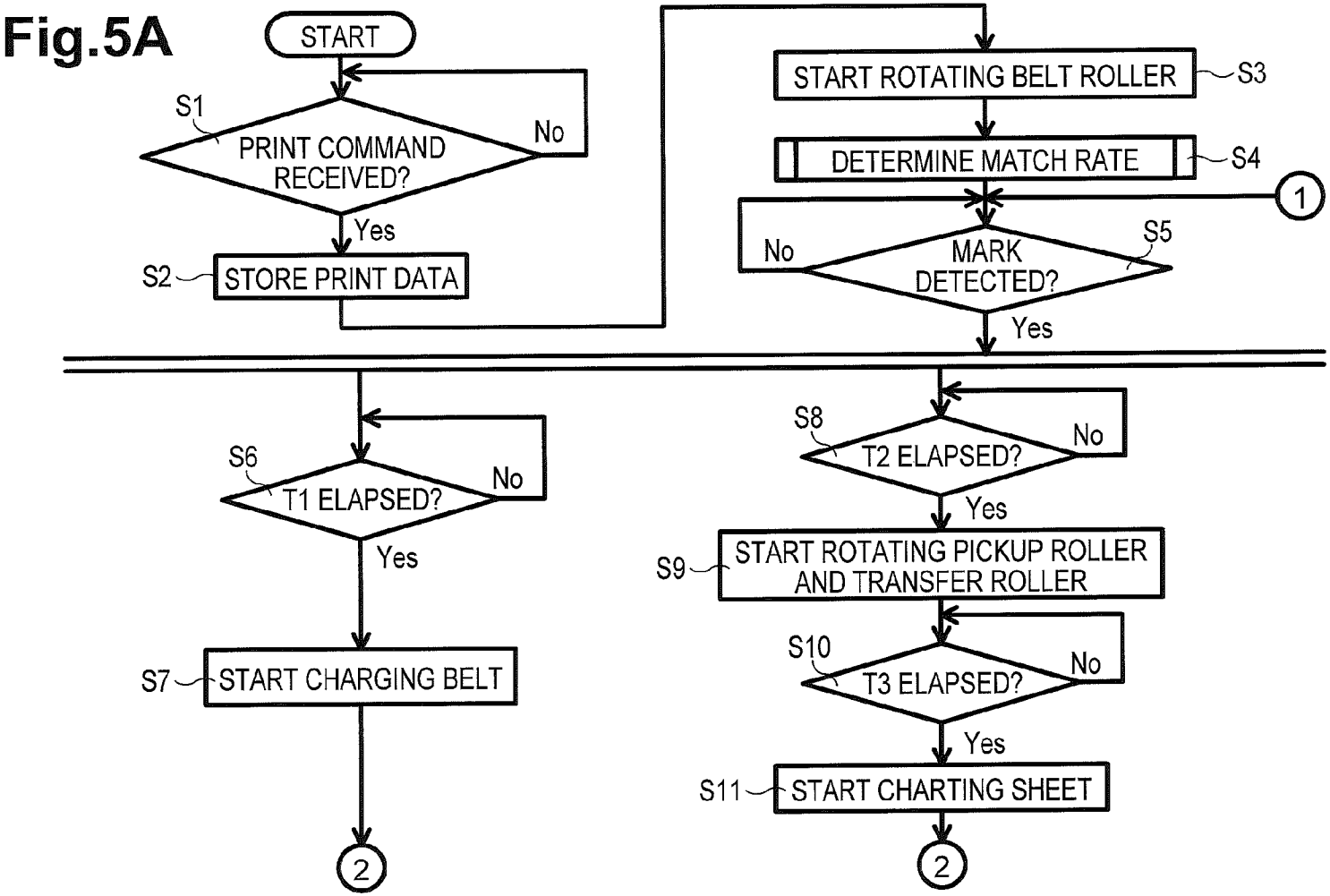
FIG. 5 is a flowchart of a series of printing operations of the inkjet printer shown in FIG. 1.
Figure 5B:
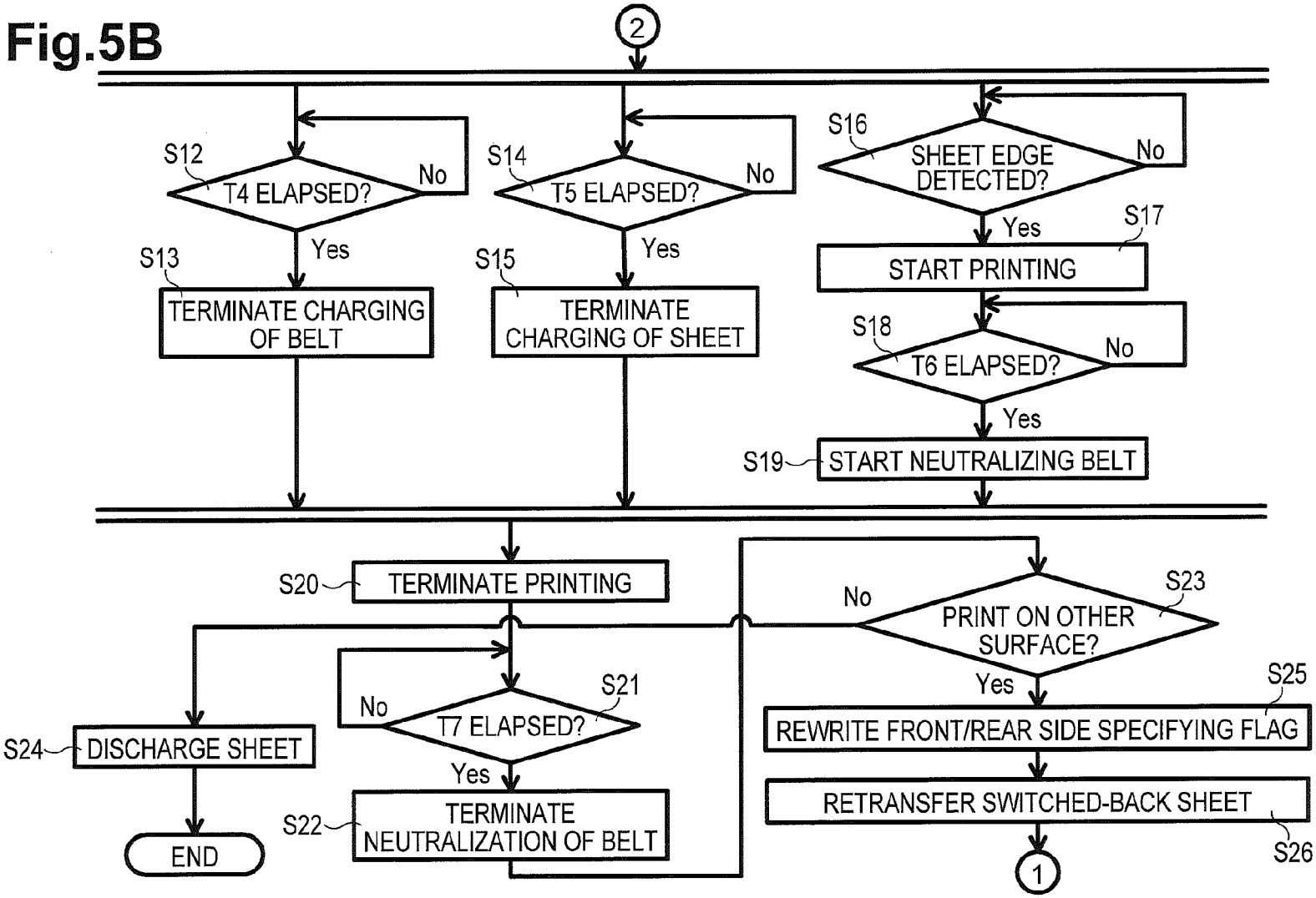
Figure 6:
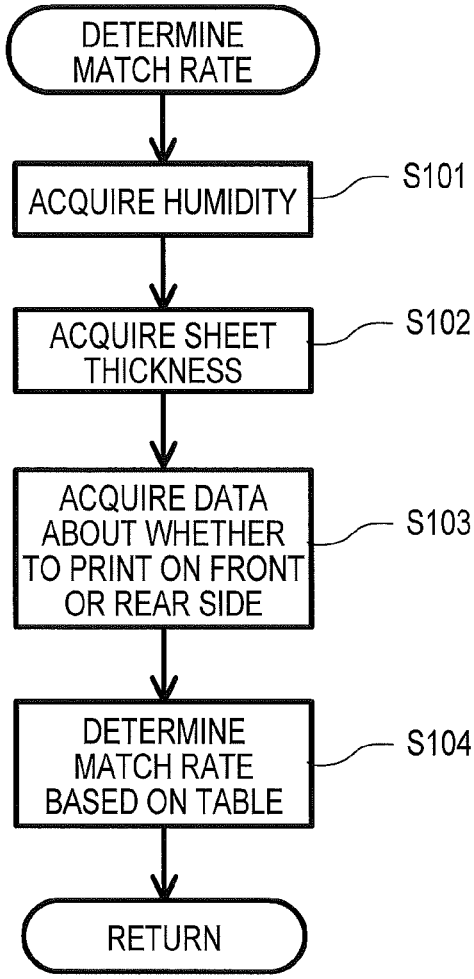
FIG. 6 is a flowchart of detailed processing in match rate determination step.
Figure 8:
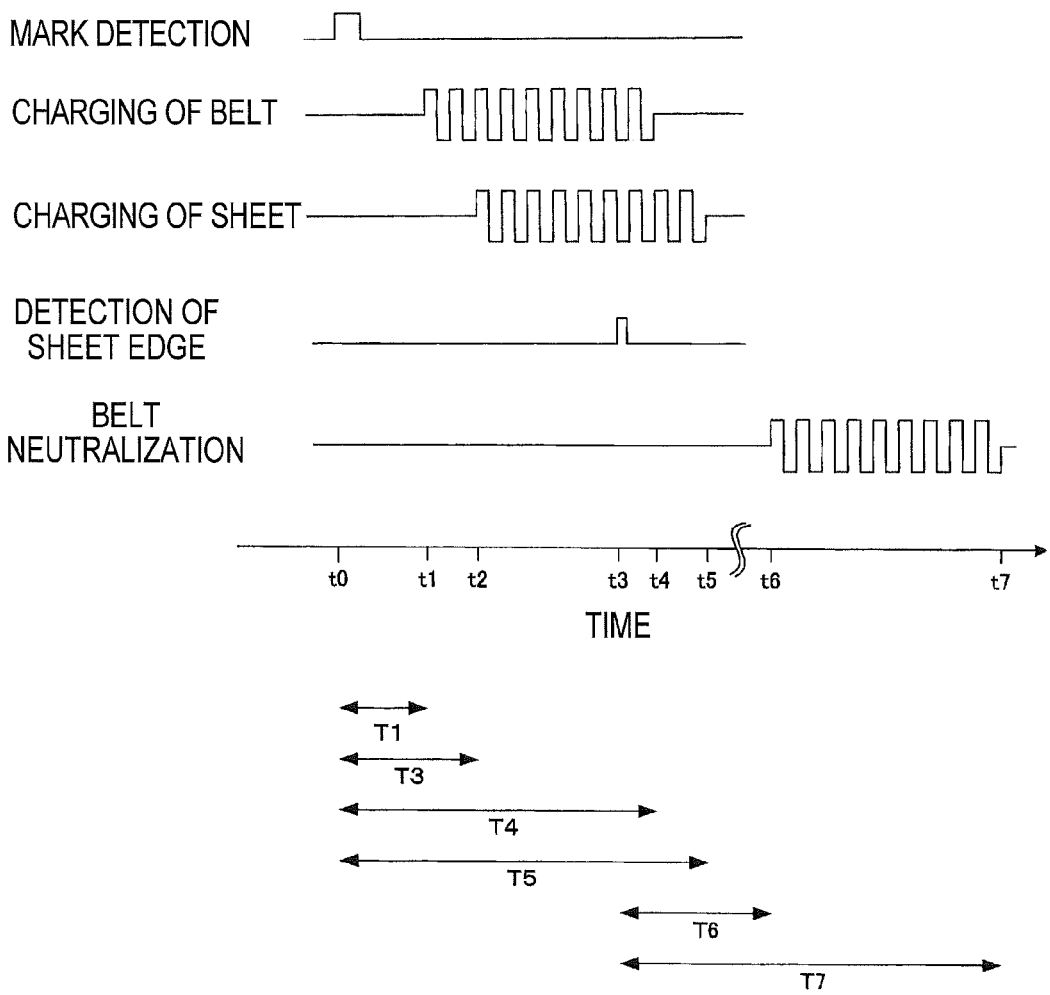
FIG. 8 is a timing chart of a series of printing operations shown in FIG. 5.

Next, a series of printing operations of the inkjet printer 1 is described with reference to flowcharts in FIGS. 5 and 6 and a timing chart in FIG. 8.

First, in step S1, the processing waits for reception of a print command including print data from the PC100. Upon receiving the print command (S1: YES), in step S2, print data included in the received print command is stored in the printed data storage unit 111.

In step S3, the transport control unit 103 controls the motor driver 124 to drive the belt drive motor 134 to start rotating the belt roller 42. As a result, the conveyor belt 43 is rotated at a constant speed.

In step S4, a match rate used for printing with the transport control unit 103 is determined. The match rate is determined in accordance with a procedure shown in FIG. 6. First, in step S101, a humidity signal output from the humidity sensor 138 is obtained. Then, in step S102, a thickness of the sheet P corresponding to an active identification number specified by the sheet thickness storage unit 112 is acquired. Further, in step S103, a front/rear side specifying flag stored in the front/rear side specifying unit 113 is acquired. Then, in step S104, the transport control unit 103 determines a match rate in accordance with a combination of the internal humidity of the casing 1*a*, the thickness of the sheet P, and whether to print an image on the front/rear side upon two-sided printing using the match rate determination table stored in the match rate determination table storage unit 114. At this time, the charging voltage applied to the sheet P and the charging voltage applied to the conveyor belt 43 are kept constant.

Figure 7:
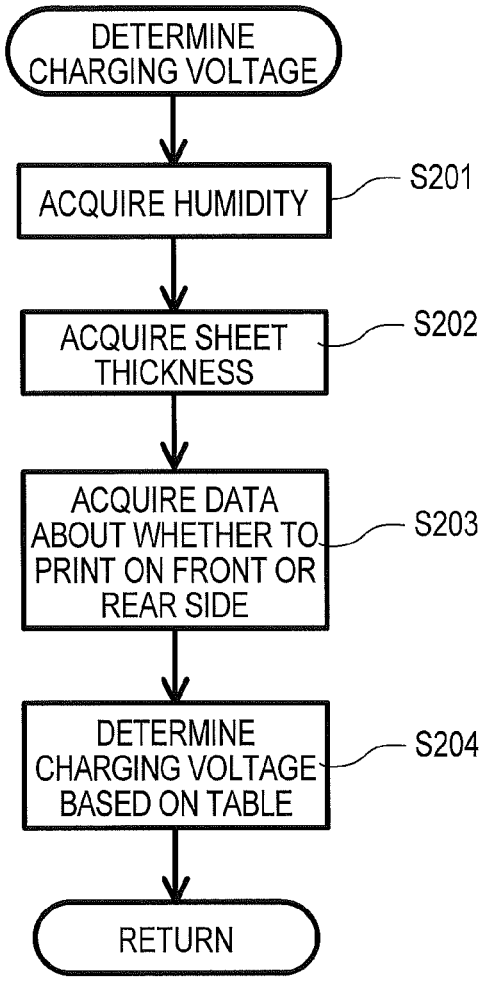
FIG. 7 is a flowchart of detailed processing in charged voltage determination step according to a modification.

A modified example of the processing in step S4 is described with reference to FIG. 7. In this modified example, the match rate is kept constant (for example, match rate=1) and in addition, the charging voltage of the power supplies 141 and 142 is set variable. Then, an appropriate charging voltage is determined in accordance with a combination of the internal humidity of the casing 1*a*, the thickness of the sheet P, and whether to print an image on the front/rear side upon single-sided printing and two-sided printing. First, in step S201, a humidity signal output from the humidity sensor 138 is acquired. Then, in step S202, the thickness of the sheet P corresponding to an active identification number specified by the sheet thickness storage unit 112 is acquired. Moreover, in step S203, the front/rear side specifying flag stored in the front/rear side specifying unit 113 is acquired. Then, in step S204, the transport control unit 103 determines the charging voltage in accordance with a combination of the internal humidity of the casing 1*a*, the thickness of the sheet P, and whether to print an image on the front/rear side upon two-sided printing using the charging voltage determination table stored in the charging voltage determination table storage unit for each of the power supplies 141 and 142.

Subsequently, in step S5, the processing waits until the belt sensor 137 detects a mark formed on the conveyor belt 43.

After the detection of the mark, in step S6, the processing waits until the time t1 after the elapse of time T1 from the time t0 at which the belt sensor 137 detected the mark. At time t1, the front edge of the sheet placement region formed in the conveyor belt 43 reaches the belt charging roller 136. The time T1 is determined based on a distance between the sheet placement region and the mark, a distance between the belt charging roller 136 and the belt sensor 137, and a transport speed of the sheet P transported by the conveyor belt 43. Then, after the elapse of the time T1 (S6: YES), in step S7, the belt charging control unit 105 controls the power supply 142 to start charging the conveyor belt 43 by use of the belt charging roller 136. Referring to FIG. 3B, plural charged segments are formed from the front edge of the sheet placement region on the conveyor belt 43. Further, the printer 1 can be easily controlled using the belt sensor 137.

On the other hand, after the detection of the mark, in step S8, the processing waits until time T2 elapses from the time t0 at which the belt sensor 137 detected the mark. The time T2 is a time period necessary for the front edge of the sheet placement region (plural charged segments) reaches the placement position for the sheet P on the conveyor belt 43 (as denoted by P0 in FIG. 1) from the time t0. This time is determined based on a distance between a position of the front edge of the sheet placement region and the placement position and the transport speed at time t0. After the elapse of the time T2 (S8: YES), in step S9, the transport control unit 103 controls the motor drivers 122 and 123 to start driving the pickup motor 132 and the transfer motor 133, and the pickup roller 25 and the transport roller pairs 21 and 22 start rotating. Thus, the top sheet P in the feeding cassette 242 is fed and transferred through the transfer path 19. In parallel therewith, the front edge of the sheet placement region passes the placement position and moves toward the inkjet head 2. A certain amount of time is further necessary for the sheet P to reach the placement position. Thus, the sheet P is placed in any charged segment without fail. Although the time t2 is not shown in FIG. 8, it is a predetermined value smaller than the time T3.

Subsequently, the processing waits until time t2 after the elapse of time T3 from time t0 in step S10. At time t2, the front edge of the sheet P transferred through the transfer path 19 reaches the roller pair 22. The time T3 is the sum of the time T2 and the quotient of the distance between the feeding cassette 24 and the roller pair 22 divided by the transfer speed for the sheet P transferred through the transfer path 19. Then, after the elapse of the time T3 (S10: YES), in step S11, the sheet charging control unit 106 controls the power supply 141 to start charging the sheet P by use of the sheet charging rollers 22*a* and 22*b*. Referring to FIG. 3A, plural charged segments are formed in the sheet P. The processing in steps S6 and S7 is performed in parallel to the processing in steps S8 to S11. From the viewpoint of certainly placing the sheet P on the charged segment, the front edge of the charged sheet P only needs to reach the placement position after the front edge of the sheet placement region. To satisfy the condition, the start time or duration of each step is adjusted.

After a while from steps S7 and S11, the front edge of the sheet P reaches a position on the conveyor belt 43 (placement position: P0). From then on, the sheet P is successively placed on the conveyor belt 43 from the front edge of the sheet P to the rear edge. A match rate of the plurality of charged segments formed in the sheet P and the plurality of charged segments in the conveyor belt 43 is 0.8 or more, and an attraction force is generated between each charged segment formed in the sheet P and each charged segment formed in the conveyor belt 43. In this way, both of the sheet P and the conveyor belt 43 are charged in advance, making it possible to quickly attract the sheet P to the conveyor belt 43. Thus, high-speed transport and high-speed printing are realized using the printer 1. Further, even if an ink layer (containing a conductive material such as carbon black) is formed on the lower surface of the sheet P and the outer surface of the conveyor belt 43, an attraction force is rarely reduced. Hence, it is possible to prevent the sheet P from floating from the conveyor belt 43. Accordingly, a gap between the head 2 and the conveyor belt 43 can be reduced down to, for example, about 0.5 mm. Thus, an accuracy of ejection of ink droplets on the sheet P is improved.

In particular, all the charged segments formed on the conveyor belt 43 have the same match rate, and an attraction force applied to the sheet P on the conveyor belt 43 can become uniform. Accordingly, a large attraction force can be obtained with a small charging amount. Further, the charged segments have the same length, which simplifies control. Further, since the match rate is set to 0.8 or more, a large attraction force can be obtained. In particular, if the match rate is 1.0, the sheet P is held on the conveyor belt 43 with a very large attraction force.

Further, the match rate is set variable, making it possible to adjust an attraction force. The match rate is determined in accordance with a combination of the internal humidity of the casing 1*a*, the thickness of the sheet P, and whether to form an image on one surface upon single-sided printing and on the front/rear side upon two-sided printing in step S4. Thus, the sheet P can be transported with an appropriate attraction force. In addition, changing the match rate to adjust an attraction force is advantageous in that the power supply circuit can be simplified compared with the case of setting the charging voltage of the power supplies 141 and 142 illustrated in FIG. 7 variable. Further, an attraction force can be adjusted also by setting the charging voltage of the power supplies 141 and 142 illustrated in FIG. 7 variable. In the above modified example, a charging voltage of the power supplies 141 and 142 is determined in accordance with a combination of the internal humidity of the casing 1*a*, the thickness of the sheet P, and whether to form an image on the front/rear side upon two-sided printing in step S4. Hence, the sheet P can be conveyed with an appropriate attraction force.

As described above, a charging amount of one charged segment on the sheet P is smaller than a charging amount of one charged segment on the conveyor belt 43. Thus, a leak field to the outside of the sheet P (in a direction opposite to the direction from the sheet P to the conveyor belt 43) is suppressed. Therefore, occurrences of an electric disturbance outside of the sheet P during the transfer can be suppressed. As a result, a change in fly path of ink droplets due to the leak field can be suppressed. Further, this contributes to reduction of noise on the electric signal.

Moreover, in this embodiment, the sheet charging roller 22*a* charges an opposite surface of the sheet P to the surface in contact with the conveyor belt 43. Therefore, a dry surface is charged all the time even during printing on the second surface. Accordingly, neutralization of charges rarely occurs due to humidity of an ink droplet ejected from the head 2, and an attraction force is less changed. As a modified example thereof, the sheet charging roller 22*b* may charge the surface of the sheet P in contact with the conveyor belt 43. At this time, electric bonding between charges in the conveyor belt 43 and charges in the sheet P becomes firm, and occurrences of electric disturbance outside of the sheet P during the transfer can be suppressed considerably.

Moreover, after the detection of the mark, in step S12, the processing waits until time t4 after the elapse of time T4 from time t0. At time t4, the rear edge of the sheet placement region formed in the conveyor belt 43 reaches the belt charging roller 136. The time T4 is the sum of the time T1 and the quotient of the distance of the sheet placement region along the transport path 20 divided by the transfer speed for the sheet P conveyed on the conveyor belt 43. Then, after the elapse of the time T4 (S12: YES), in step S13, the belt charging control unit 105 controls the power supply 142 to complete charging the conveyor belt 43 with the belt charging roller 136.

On the other hand, in step S14, the processing waits until time t5 after the elapse of time T5 from time t0. At time t5, the rear edge of the sheet P transferred through the transfer path 19 reaches the roller pair 22. The time T5 is the sum of the time T3 and the quotient of the distance of the sheet P along the transport path 19 divided by the transfer speed for the sheet P transferred through the transfer path 19. Then, after the elapse of the time T5 (S14: YES), in step S15, the sheet charging control unit 106 controls the power supply 141 to complete charting the sheet P with the sheet charging rollers 22*a* and 22*b*. As described above, only for a period in which the sheet charging rollers 22*a* and 22*b* hold the sheet P, the power supply 141 operates and in addition, the power supply 142 operates to charge only a region of the conveyor belt 43 on which the sheet P is to be placed, as a charged segment. This makes it possible to shorten an operation time for the power supplies 141 and 142. Hence, the service life thereof can be increased, and power consumption thereof can be reduced.

Further, the processing waits until the sheet edge sensor 51 outputs a sheet edge detection signal in step S16. Then, if the sheet edge detection signal is output at time t3 (S16: YES), after the elapse of a predetermined time from then, in step S17, the head control unit 102 controls the head drive circuit 121 to start printing on the sheet P with the head 2.

Subsequently, in step S18, the processing waits until time t6 after the elapse of T6 from the time t3. The time T6 is the sum of the quotient of the distance between the sheet edge sensor 51 and the neutralization plate 45 divided by the transfer speed for the sheet P conveyed on the conveyor belt 43. Then, after the elapse of time T6 (S18: YES), in step S19, the neutralization control unit 107 controls the power supply 143 to start neutralization of the conveyor belt 43 with the neutralization plate 45. As a modified example thereof, the time to start and terminate neutralization may be controlled based on the elapsed time from time t0. In addition, in step S19, the neutralization is started only when the front edge of the sheet P reaches the neutralization plate 45. At this time, the front edge of the charged sheet placement region first reaches a position on the upstream side of the front edge of the sheet P. However, charges are neutralized until this region is charged again with the belt charging roller 136.

The processing in steps S12 and S13, the processing in steps S14 and S15, and the processing in steps S16 to S19 are performed in parallel with each other. The sequence of the time t3, the time t4, and the time t5 as shown in FIG. 8 is determined for illustrative purposes only, and the time t3 may follow the time t4 or the time t5. From the viewpoint of certainly placing the sheet P on the charged segment until the image formation on the sheet P is completed, the rear edge of the charged sheet P only needs to reach the placement position ahead of the rear end of the sheet placement region. The start time or duration of each step is adjusted to satisfy the above condition.

If the rear edge of the sheet P passes the head 2 at the most downstream position along the transport path, in step S20, the head control unit 102 completes printing on the sheet P with the head 2. In step S21, the processing waits until time t7 after the elapse of time T7 from time t3. The time T7 is the sum of the quotient of the total distance of the distance between the sheet edge sensor 51 and the neutralization plate 45 and the length of the sheet P divided by the transfer speed for the sheet P conveyed on the conveyor belt 43. Then, after the elapse of the time T7 (S21: YES), in step S22, the neutralization control unit 107 completes neutralization of the conveyor belt 43 with the neutralization plate 45.

During a period from step S19 to step S22, the neutralization plate 45 is charged with an opposite phase to the phase of the charged segment in the conveyor belt 43 on the neutralization plate 45. Thus, the charged segment formed in the conveyor belt 43 during previous charging operation can disappear. Accordingly, a charged segment can be formed in the conveyor belt 43 in the next charging operation without considering a position of the charged segment formed in the conveyor belt 43 in the previous charging operation. In other words, a charged state becomes uniform at any time, and the degree of freedom of position at which a charged segment is formed in the conveyor belt 43 can be increased. Moreover, a potential of the conveyor belt 43 can be kept from gradually increasing. In particular, the neutralization plate 45 is charged with an opposite phase to the phase of the charged segment in the conveyor belt 43. Thus, the charged segment formed in the conveyor belt 43 can disappear with high reliability. Moreover, the neutralization plate 45 is disposed between the separation position of the sheet P and the plurality of heads 2, which facilitates separation of the sheet P from the conveyor belt 43.

Subsequently, it is determined whether to print the rear side of a sheet having an image printed on the front side in step S23, and steps S17 to S20, that is, whether to print an image on a second surface after printing an image on a first surface of the sheet P (two-sided printing). If printing on the second surface is not performed or an image is printed on the second surface of the sheet in steps S17 to S20 (S23: NO), the processing advances to step S24, and the sheet P is directly discharged to the discharge recess 6 to terminate the printing processing. Since each sheet P is alternately charged with two polarities, the charged segment formed in the sheet P can easily disappear in a short time after the transfer. Accordingly, handling property of the plural transferred sheets P stacked in the discharge recess 6 is rarely reduced.

In the case of printing an image on the second surface (S23: YES), in step S25, the front/rear side specifying flag stored in the front/rear side specifying unit 113 is rewritten to a value corresponding to an instruction to print an image on the second surface upon two-sided printing. Moreover, in step S26, the sheet P is switched back. In other words, after the rear edge of the sheet P fed from the transport unit 40 passed a portion where the path branches off to the retransport path 70, the transport roller pairs 34 and 35 are rotated in the reverse direction to thereby feed the sheet P to the retransport path 70. The sheet P retransported through the retransport path 70 is stopped with its front edge being in contact with the transport roller pair 21. Then, the processing returns to step S4, and the match rate is determined upon printing on the second surface.

After a while, an image is printed on the second surface in accordance with the above procedure. In this case as well, an operation of charging the sheet placement region or the start time of the operation of charging the sheet P are set with reference to the detection time of the mark on the conveyor belt 43 as a starting point. The start time of the transfer of the sheet P with the transport roller 21 is set after the elapse of a predetermined time from when the sheet placement region reaches a placement position. The predetermined time corresponds to a time necessary for the sheet P fed from the feeding cassette 24 reaches the transport roller 21. With this construction, the sheet P is placed and conveyed on the conveyor belt 43, subjected to image formation with the inkjet heads 2, and separated from the conveyor belt 43 similar to the first surface. In the case of printing an image on the second surface of the sheet P upon two-sided printing, if an ink layer formed through printing on the first surface is not dried, a resistance value of the sheet P is reduced, and charges in the sheet P are easily neutralized in a short time. However, by forming the charged segment in the sheet P using the sheet charging rollers 22*a* and 22*b*, the sheet P can be attracted to the conveyor belt 43 with a large attraction force. In particular, since the sheet charging roller 22*a* is brought into contact with the second surface on which an ink layer is not formed to thereby form the charged segment, an attraction force is rarely reduced. Further, the match rate is higher upon printing on the second surface than upon printing on the first surface. Therefore, it is possible to suppress reduction in attraction force due to the first surface having an ink layer containing a conductive material formed on the surface, which opposes the conveyor belt 43, upon printing on the second surface. Also in the modified example shown in FIG. 7, a charging voltage of the power supplies 141 and 142 upon printing on the second surface is higher than the charging voltage upon printing on the first surface. This makes it possible to suppress reduction in attraction force upon printing on the second surface.

As described above, both of the sheet P and the conveyor belt 43 are charged, and charging patterns of the sheet P and the conveyor belt 4 have a predetermined relationship. Thus, the sheet P can be quickly attracted to the conveyor belt 43 by means of an attraction force applied between each charged segment formed in the sheet P and each charged segment formed in the conveyor belt 43. Accordingly, a mechanism for pressing the sheet P to the conveyor belt 43 until the sheet P is certainly attracted to the conveyor belt 43 can be omitted. Moreover, it is unnecessary to take a measure for reducing an amount of ink applied to the first surface that would reduce an attraction force generated through charging upon printing on the second surface or a measure for drying ink adhering to the first surface before printing on the second surface.

The embodiments of the present invention are described above, but the present invention is not limited to the above embodiments, and various design changes may be performed on the embodiments. For example, in the above embodiments, the transport mechanism transports a medium on a belt, but the transport mechanism may transport a medium with a drum. In the above embodiments, the sheet thickness storage unit is provided as the thickness specifying unit. A sensor for measuring the thickness of the sheet P may be provided instead.

Further, in the above embodiment, an operation timing of the pickup motor 132 and the transfer motor 133 is controlled to adjust the match rate of charged segments formed in the sheet P to the charged segments formed in the conveyor belt 43. However, the match rate may be adjusted by controlling not only the pickup motor 132 and the transfer motor 133 but also at least one of the pickup motor 132, the transfer motor 133, the belt drive motor 134, the power supply 141, and the power supply 142.

In the above embodiments, the charging voltage increases as the thickness of the sheet P increases for each of the power supplies 141 and 142, and the charging voltage increases as the internal humidity of the casing 1*a* increases. Moreover, the charging voltage upon printing on the second surface is higher than upon printing on the first surface. However, the charging voltage may increase as the thickness of the sheet P increases for either the power supply 141 or 142. In addition, the charging voltage may increase as the internal humidity of the casing 1*a* increases for either the power supply 141 or 142. The charging voltage upon printing on the second surface may be higher than upon printing on the first surface for either the power supply 141 or 142. Further, a power supply may be provided independently for the sheet charging roller 22*a* and the sheet charging roller 22*b*, and the above control may be performed for only one of the two power supplies.

In the above embodiments, the power supply 143 is connected to the neutralization plate 45, but the neutralization plate 45 may be simply grounded. In the above embodiments, the neutralization plate 45 is positioned in the internal space of the conveyor belt 43 but may be positioned outside the conveyor belt 43. Further, in the above embodiments, the conveyor belt 43 is charged by the belt charging roller 136 in the direction from the outer surface. However, the conveyor belt 43 may be charged in the direction from the inner surface. Moreover, in the above embodiment, the roller pair 22 functions as both of the charging device and the transfer unit 30, but the charging device may be disposed independently of the transfer unit 30.

Further, the inkjet printer of the above embodiments enables two-sided printing, but the present invention is applicable to an inkjet printer not having retransport path 70, which enables only single-sided printing.

Further, in the above embodiments, the medium conveyed with the conveyor belt 43 is the sheet P. However, the present invention is applicable to a transport device or recording device for transferring a transparent plastic film (sheet member) containing PET, polycarbonate, polyvinyl chloride, or polyethylene, a white opaque film, or cloth in addition to the paper including high-quality paper. Moreover, the flat platen 44 that secures the flatness of the sheet P and a head gap is disposed independently of the neutralization plate 45 but may be integrally formed. At this time, a neutralization electrode is buried in a resin layer of the flat platen 44.

Further, in the above embodiments, the match rate determination table storage unit 114 determines a match rate depending on the humidity, the sheet thickness, and whether to print an image on two sides. In addition, the match rate may be determined while considering the type of sheet. For example, as for plain paper, non-coated paper such as high-quality paper, and coated paper, a match rate is higher in the coated paper. In addition, in the case of disposing the charging voltage determination table storage unit, the charging voltage may be determined while considering the type of sheet as well. The charging voltage is higher in the coated paper.

Further, in the above embodiment, as a method for adjusting an attraction force between the sheet P and the conveyor belt 43, either a method of adjusting the match rates for the charged segments or a method for changing the charging voltage for forming each charged segment is adopted. However, a combination thereof may be adopted. At this time, a combination of the match rate and the charging voltage is determined according to a combination of the humidity of the casing 1*a*, the thickness of the sheet P, and whether to print an image upon single-sided printing or on the front/rear side upon two-sided printing.

In the above embodiments, as in step S8, when the front edge of the sheet placement region reaches the placement position, the operation of feeding the sheet P and subsequent operation of transferring the sheet P along the transfer path 19 are started. However, from the viewpoint of certainly placing the sheet P on the charged segment, the front edge of the sheet P only needs to reach the placement position ahead of the front edge of the sheet placement region. The sheet feeding operation is started from time t0, and a time necessary for the front edge of the sheet P to reach the placement position through the transfer path 19 may be set shorter than the time T2. As long as this condition is satisfied, the start time of the sheet feeding operation may be set before or after the time t1 or set to the time t0.

Further, as described in step S19, the start time of neutralization of the neutralization plate 45 is adjusted to the time at which the front edge of the sheet P reaches the placement position, but may be set to the time at which the front edge of the sheet placement region reaches the position of the neutralization plate 45. With this construction, each time the belt charging roller 136 charges the sheet placement region, uniform charged state can be obtained at any time.

Moreover, as described in step S22, the stop time of neutralization is adjusted to the time at which the rear end of the sheet P reaches the placement position but may be set to the time at which the rear edge of the sheet placement region reaches the position of the neutralization plate 45. With this construction, each time the belt charging roller 136 charges the sheet placement region, uniform charged state is obtained at any time.

Moreover, the present invention is applicable to a recording device of another type in place of the inkjet printer 1 including the inkjet head 2, such as a printing having a thermal head for thermal transferring ink on the sheet P. Further, the present invention is applicable to a transport device for transporting a medium including a reading device such as a scanner in place of the recording device.

What is claimed is:

1. A transport device comprising:

a transport mechanism comprising a supporting member configured to support a placed medium and transport the medium along a transport path along with movement of the supporting member;

a first charging device configured to alternately charge the supporting member with one polarity and an opposite polarity along the transport path to form a plurality of charged segments in the supporting member;

a transfer mechanism configured to transfer the medium to the supporting member to place the medium on the supporting member;

a second charging device configured to alternately charge the medium with one polarity and an opposite polarity along the transfer path for transferring the medium with the transfer mechanism before the transfer mechanism places the medium on the supporting member to form a plurality of charged segments in the medium; and a control unit configured to control at least one of the transport mechanism, the transfer mechanism, the first charging device, and the second charging device such that a charging pattern of the placed medium and a charging pattern of the supporting member have a predetermined relationship on the supporting member.

2. The transport device according to claim 1, wherein the control unit is configured to control at least one of the transport mechanism, the transfer mechanism, the first charging device, and the second charging device such that a match rate indicating a rate of the charged segment having a second polarity, formed in the medium with the second charging device and overlapped with the supporting member to the charged segment having a first polarity formed on the supporting member with the first charging device, matches a match rate of all of the charged segments formed in the supporting member.

3. The transport device according to claim 2, wherein the plurality of charged segments formed in the supporting member have the same length along the transport path, and the plurality of charged segments formed in the medium have the same length along the transport path, and one charged segment of the supporting member and one charged segment in the medium have the same length along the transport path.

4. The transport device according to claim 3, wherein the control unit is configured to control at least one of the transport mechanism, the transfer mechanism, the first charging device, and the second charging device such that a charged segment of a first polarity formed in the medium opposes any charged segment of a second polarity formed in the supporting member, on the supporting member.

5. The transport device according to claim 1, further comprising a neutralization device configured to neutralize the supporting member.

6. The transport device according to claim 5, wherein the neutralization device is configured to apply charges having an opposite polarity to a polarity of each of the charged segments formed in the supporting member to the charged segment to neutralize the supporting member.

7. The transport device according to claim 1, further comprising an operation sensor configured to detect an operation of the supporting member, wherein the control unit is configured to control at least one of the first charging device and the second charging device based on a detection result of the operation sensor such that a charging pattern of the medium and a charging pattern of the supporting member have the predetermined relationship on the supporting member.

8. The transport device according to claim 1, further comprising an operation sensor configured to detect an operation of the supporting member, wherein the control unit is configured to control at least one of the transport mechanism and the transfer mechanism based on a detection result of the operation sensor to place the medium on a predetermined region of the supporting member, and control the first charging device and the second charging device such that the first charging device operates only in a period for charging the predetermined region of the supporting member is charged, and the second charging device operates only in a period for charging the medium.

9. The transport device according to claim 1, wherein the control unit is configured to control at least one of the transport mechanism, the transfer mechanism, the first charging device, and the second charging device such that a match rate indicating a rate of the charged segment having a second polarity formed in the medium and overlapped with the supporting member to the charged segment having a first polarity formed on the supporting member is variable.

10. The transport device according to claims 1, further comprising a humidity sensor, wherein the control unit is configured to control at least one of the first charging device and the second charging device such that at least one of a charging voltage of the first charging device and a charging voltage of the second charging device becomes higher as a value of humidity detected by the humidity sensor increases.

11. The transport device according to claim 1, further comprising a thickness specifying unit configured to specify a thickness of the sheet-like medium, wherein the control unit is configured to control at least one of the first charging device and the second charging device such that at least one of a charging voltage of the first charging device and a charging voltage of the second charging device becomes higher as a thickness of the medium specified by the thickness specifying unit increases.

12. The transport device according to claim 1, wherein a charged amount of one charged segment of the medium, which is charged with the second charging device is smaller than a charged amount of one charged segment of the supporting member, which is charged with the first charging device.

13. The transport device according to claim 1, wherein the supporting member is an endless belt, and the transport mechanism further comprises a plurality of rollers between which the belt is stretched.

14. A recording device comprising:

the transport device according to claim 1; and a liquid ejection head configured to eject a liquid to the recording medium supported by the supporting member.

15. The recording device according to claim 14, further comprising a neutralization device configured to neutralize the supporting member, wherein the neutralization device comprises a neutralization member positioned between the liquid ejection head and a separation position at which the recording medium is taken off from the supporting member so as to come into contact with the recording medium.

16. The recording device according to claim 15, wherein the neutralization member is configured to contact with an opposite surface of the recording medium to a surface supported by the supporting member.

17. The recording device according to claim 14, wherein the second charging device configured to charge an opposite surface of the medium to a surface in contact with the supporting member.

18. The recording device according to claim 14, wherein the second charging device configured to charge a surface of the medium in contact with the supporting member.

19. The recording device according to claim 14, further comprising a retransport path configured to retransport the recording medium transported with the transport mechanism such that an opposite surface comes into contact with the liquid ejection head, wherein the liquid ejection head first records an image on a first surface on the liquid ejection head side of the recording medium transported with the transport mechanism, and then a second surface of the recording medium transported with the transport mechanism through the retransport path.

20. The recording device according to claim 19, wherein the control unit is configured to control at least one of the first charging device and the second charging device to satisfy at least one of (a) a condition that a charging voltage of the first charging device applied upon recording an image on the second surface is higher than a charging voltage of the first charging device applied upon recording an image on the first surface and (b) a condition that a charging voltage of the second charging device applied upon recording an image on the second surface is higher than a charging voltage of the second charging device upon recording an image on the first surface.

* * * * *